US010283307B2

(12) United States Patent
de Leon et al.

(10) Patent No.: US 10,283,307 B2
(45) Date of Patent: May 7, 2019

(54) SURFACE MOUNT FUSE

(71) Applicant: Littelfuse, Inc., Chicago, IL (US)

(72) Inventors: Conrado de Leon, Manila (PH); Albert Enriquez, Batangas (PH)

(73) Assignee: Littelfuse, Inc., Chicago, IL (US)

( * ) Notice: Subject to any disclaimer, the term of this patent is extended or adjusted under 35 U.S.C. 154(b) by 2 days.

(21) Appl. No.: 15/479,572

(22) Filed: Apr. 5, 2017

(65) Prior Publication Data

US 2018/0294126 A1 Oct. 11, 2018

(51) Int. Cl.

| | |
|---|---|
| ***H01H 85/143*** | (2006.01) |
| ***H01H 69/02*** | (2006.01) |
| ***H01H 85/175*** | (2006.01) |
| ***H01H 85/38*** | (2006.01) |
| *H01H 85/041* | (2006.01) |

(52) U.S. Cl.

CPC ..... *H01H 85/143* (2013.01); *H01H 69/02* (2013.01); *H01H 85/175* (2013.01); *H01H 85/38* (2013.01); *H01H 2085/0414* (2013.01)

(58) Field of Classification Search

CPC .... H01H 69/02; H01H 85/143; H01H 85/175; H01H 2085/0412; H01H 2085/0414

USPC ..... 337/227

See application file for complete search history.

(56) References Cited

U.S. PATENT DOCUMENTS

| | | | | |
|---|---|---|---|---|
| 4,511,875 | A * | 4/1985 | Arikawa | H01H 85/0411 337/186 |
| 5,130,688 | A * | 7/1992 | Van Rietschoten | H01H 85/0411 337/231 |
| 5,140,294 | A * | 8/1992 | Rohrer | H01H 85/143 337/252 |
| 5,583,740 | A * | 12/1996 | Fujino | H01G 9/0003 361/274.1 |
| 2003/0024105 | A1* | 2/2003 | Chiu | H01H 85/0411 29/623 |
| 2004/0124962 | A1* | 7/2004 | Tseng | H01H 85/0241 337/187 |
| 2005/0035841 | A1* | 2/2005 | Kobayashi | B23K 35/262 337/157 |
| 2010/0328020 | A1* | 12/2010 | Wiryana | H01H 85/143 337/232 |
| 2012/0133478 | A1* | 5/2012 | Chiu | H01H 85/165 337/228 |
| 2016/0111240 | A1* | 4/2016 | Beckert | H01H 85/08 337/187 |
| 2016/0217960 | A1* | 7/2016 | Abad | H01H 85/38 |

* cited by examiner

*Primary Examiner* — Jacob R Crum

(57) ABSTRACT

A surface mount fuse including a fuse body having a base including a floor and a plurality of adjoining sidewalls defining an interior cavity, wherein top edges of the sidewalls define a recessed shoulder bordering the interior cavity, and a cover including a main body disposed on the recessed shoulder and enclosing the interior cavity, first and second terminals extending through opposing sidewalls of the base, the first and second terminals extending around the opposing sidewalls and the cover and disposed in abutment therewith to secure the cover to the base, and a fusible element extending through the interior cavity and connected to the first and second terminals.

9 Claims, 6 Drawing Sheets

SURFACE MOUNT FUSE

FIELD OF THE DISCLOSURE

The present disclosure relates generally to the field of circuit protection devices, and relates more particularly to a low-cost surface mount fuse and methods of manufacturing the same.

FIELD OF THE DISCLOSURE

Fuses are commonly used as circuit protection devices and are typically installed between a source of electrical power and a component in a circuit that is to be protected. One type of fuse, commonly referred to as a "surface mount fuse," includes an electrically insulating fuse body containing a fusible element that extends between electrically conductive, metallic terminals that extend through opposing longitudinal ends of the fuse body. The terminals are typically bent around the ends of the fuse body to the underside of the fuse body for providing electrical connections to a printed circuit board (PCB). Upon the occurrence of a specified fault condition, such as an overcurrent condition, the fusible element melts or otherwise separates to interrupt the flow of electrical current between an electrical power source and a protected component.

The market for surface mount fuses is highly competitive, and manufactures of surface mount fuses must minimize production costs in order to be competitive. It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of a surface mount fuse in accordance with the present disclosure may include a fuse body having a base including a floor and a plurality of adjoining sidewalls defining an interior cavity, wherein top edges of the sidewalls define a recessed shoulder bordering the interior cavity, and a cover including a main body disposed on the recessed shoulder and enclosing the interior cavity, first and second terminals extending through opposing sidewalls of the base, the first and second terminals extending around the opposing sidewalls and the cover and disposed in abutment therewith to secure the cover to the base, and a fusible element extending through the interior cavity and connected to the first and second terminals.

An exemplary embodiment of a method for manufacturing a surface mount fuse in accordance with the present disclosure may include molding a base of a fuse body around first and second terminals, the base including a floor and a plurality of adjoining sidewalls defining an interior cavity, the first and second terminals extending through opposing sidewalls of the base.

Another exemplary embodiment of a method for manufacturing a surface mount fuse in accordance with the present disclosure may include molding a base of a fuse body around first and second terminals, the base including a floor and a plurality of adjoining sidewalls defining an interior cavity, the first and second terminals extending through opposing sidewalls of the base, connecting a fusible element to the first and second terminals, the fusible element extending through the interior cavity, disposing a main body of a cover of the fuse body on a recessed shoulder formed in top edges of the sidewalls of the base, wherein flanges extending from longitudinal ends of the main body are disposed in complementary notches formed in the top edges of the opposing sidewalls, and bending the first and second terminals around the opposing sidewalls and the cover to secure the cover to the base.

DETAILED DESCRIPTION

Figure 1A:
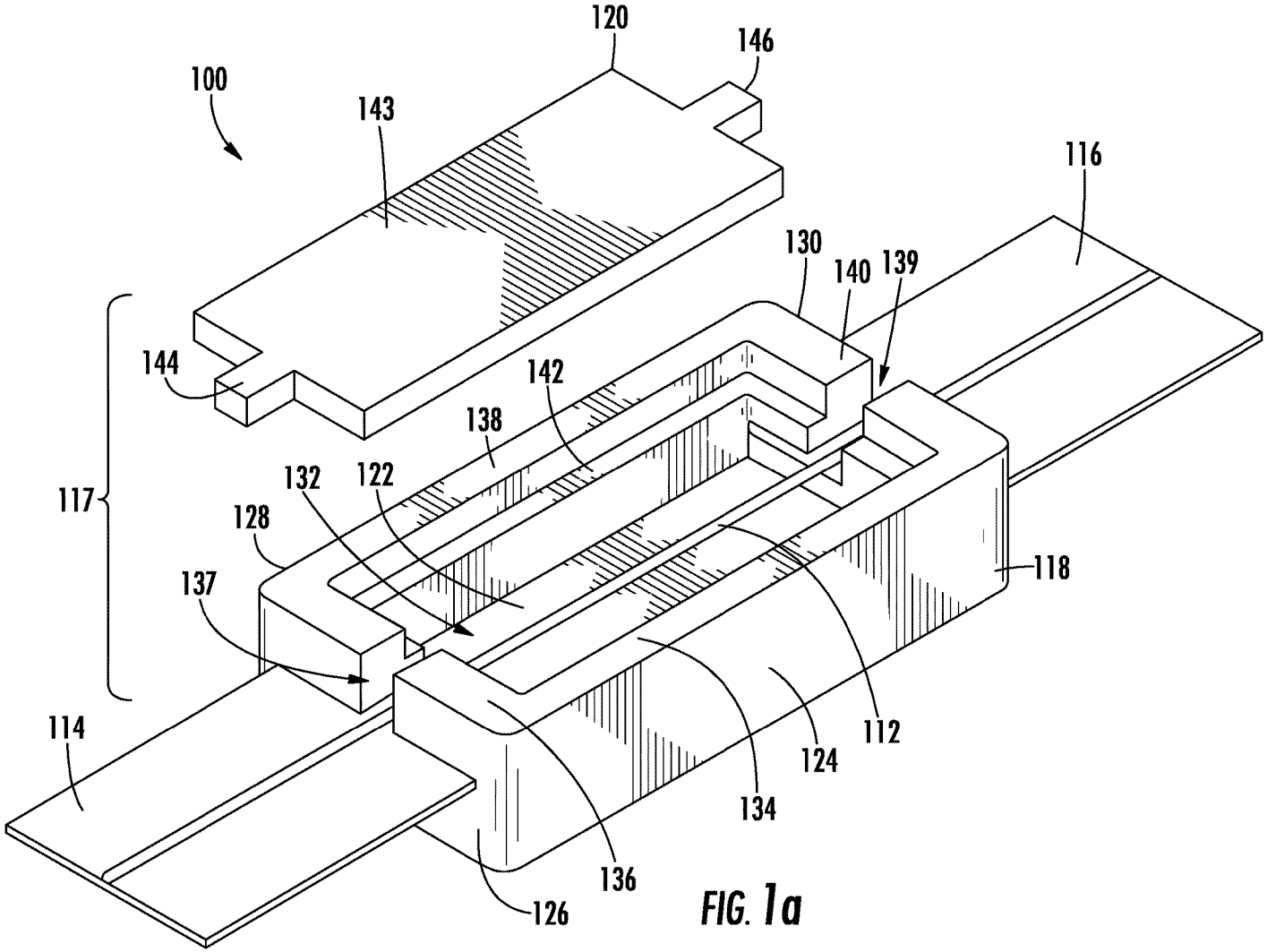
FIG. 1*a* is an exploded perspective view illustrating a surface mount fuse in accordance with an exemplary embodiment of the present disclosure.

Embodiments of a surface mount fuse and methods for manufacturing the same in accordance with the present disclosure will now be described more fully with reference to the accompanying drawings, in which preferred embodiments of the present disclosure are presented. The surface mount fuse and the accompanying methods of the present disclosure may, however, be embodied in many different forms and should not be construed as being limited to the embodiments set forth herein. Rather, these embodiments are provided so that this disclosure will be thorough and complete, and will convey certain exemplary aspects of the surface mount fuse and the accompanying methods to those skilled in the art. In the drawings, like numbers refer to like elements throughout unless otherwise noted.

Referring to FIG. 1*a*, an exploded view of a surface mount fuse 100 (hereinafter "the fuse 100") in accordance with an exemplary embodiment of the present disclosure is shown. The fuse 100 is shown in a partially assembled state as will be described in greater detail below. The fuse 100 may include a fusible element 112, first and second terminals 114, 116, and a fuse body 117 having a base 118 and a cover 120. For the sake of convenience and clarity, terms such as "top," "bottom," "longitudinal," "lateral," "vertical," and "horizontal" may be used herein to describe the relative positions and orientations of various components of the fuse 100, all with respect to the geometry and orientation of the fuse 100 as it appears in FIG. 1*a*. Said terminology will include the words specifically mentioned, derivatives thereof, and words of similar import. Similar terminology will be used in a similar manner to describe subsequent embodiments disclosed herein.

The base 118 of the fuse body 117 may be formed of an electrically insulating material (e.g., plastic, ceramic, etc.) and may include a floor 122 and adjoining sidewalls 124, 126, 128, 130 that define an interior cavity 132. Top edges 134, 136, 138, 140 of the sidewalls 124-130 may define a recessed shoulder 142 that borders the interior cavity 132. Notches 137, 139 may be formed in the top edges 136, 140 of the longitudinally-opposing sidewalls 126, 130 and may intersect the recessed shoulder 142. The cover 120 of the fuse body 117 may include a generally planar main body 143 having flanges 144, 146 extending from longitudinal ends thereof. The cover 120 may have a size and shape that are substantially similar to the aggregate size and shape of the recessed shoulder 142 and the notches 137, 139 of the base 118. The recessed shoulder 142 and the notches 137, 139 may be adapted to receive the main body 143 and the flanges 144, 146 of the cover 120 in a mating, close clearance relationship therewith. For example, when the cover 120 and base 118 are mated as shown in FIG. 1*b*, the top surface 148 of the cover 120 is substantially flush with the tops edges 134-140 of the base 118, and the longitudinal ends 150, 152 of the flanges 144, 146 are substantially flush with the sidewalls 126, 130.

Referring back to FIG. 1*a*, the first and second terminals 114, 116 of the fuse 100 may be formed from substantially planar segments of electrically conductive material (e.g., copper or one of its alloys, plated with nickel or other conductive, corrosion resistant materials) that extend through the longitudinally-opposing sidewalls 126, 130 of the fuse body 117, respectively, in a substantially parallel orientation relative to the cover 120. The first and second terminals 114, 116 may extend toward the interior cavity 132 insofar as the interior surfaces of the sidewalls 126, 130, respectively, but this is not critical. In various alternative embodiments, one or both of the first and second terminals 114, 116 may extend into the interior cavity 132.

The fusible element 112 may extend longitudinally through the interior cavity 132 and notches 137, 139 of the fuse body 117 and may be connected to the first and second terminals 114, 116 in electrical communication therewith. The fusible element 112 may be formed of any suitable electrically conductive material, including, but not limited to, tin or copper, and may be configured to melt and separate upon the occurrence of a predetermined fault condition, such as an overcurrent condition in which an amount of current exceeding a predefined maximum current flows through the fusible element 112. The fusible element 112 may be any type of fusible element suitable for a desired application, including, but not limited to, a fuse wire, a corrugated strip, a fuse wire wound about an insulating core, etc. The fusible element 112 may be connected to the first and second terminals 114, 116 using any of a variety of bonding techniques, including, but not limited to, soldering, ultrasonic welding, laser welding, resistance welding, etc. In some embodiments, the interior cavity 132 of the fuse body 117 may be partially or entirely filled with an arc-quenching material surrounding the fusible element 112. The arc-quenching material may be provided for mitigating electrical arcing that may occur upon separation of the fusible element 112. Arc-quenching materials may include, but are not limited to, sand, silica, etc.

Figures 1B, 1C:
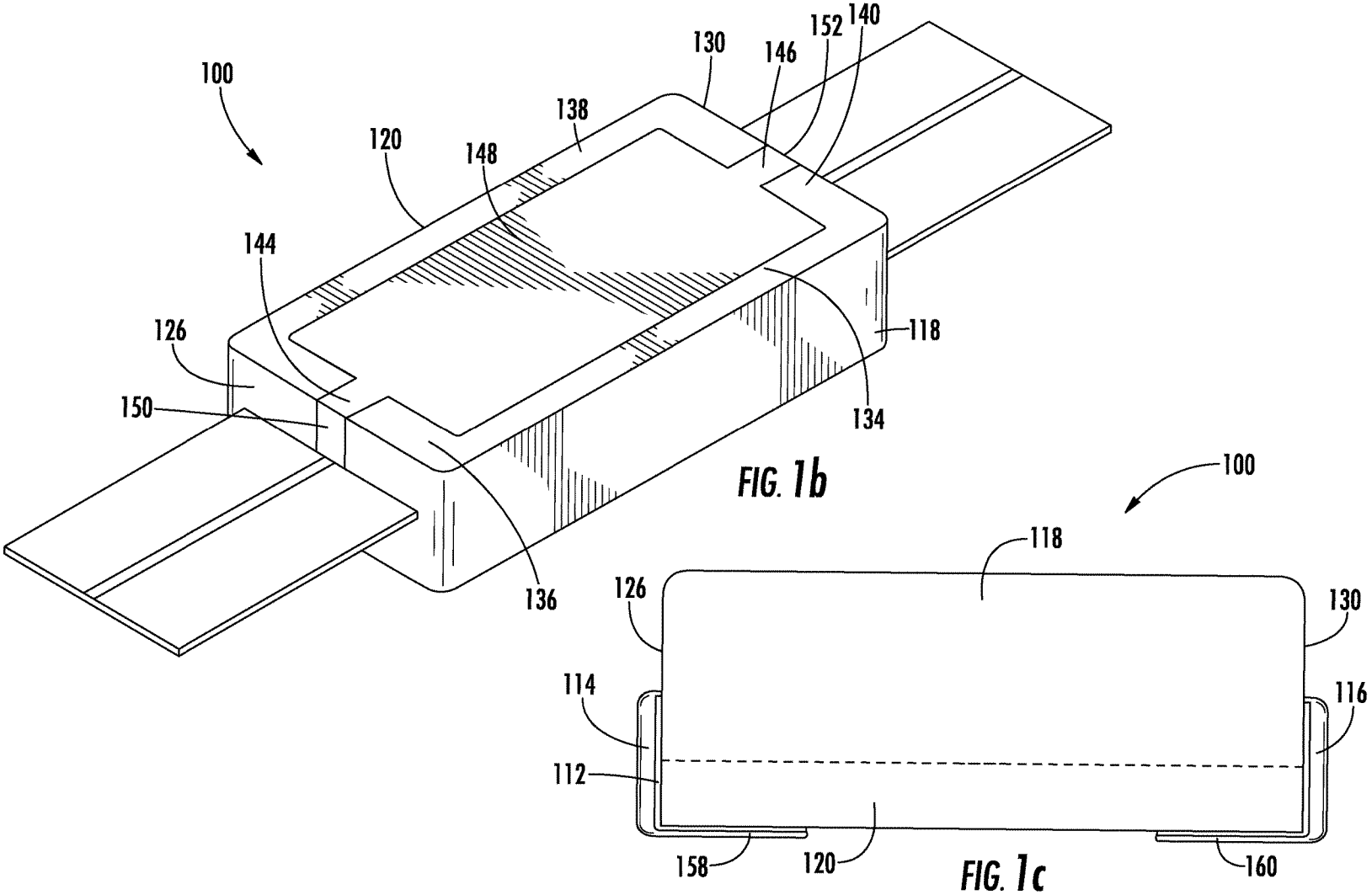
FIG. 1*b* is a perspective view illustrating the surface mount fuse shown in FIG. 1*a;*
FIG. 1*c* is a side view illustrating the surface mount fuse shown in FIG. 1*a* in a fully assembled configuration.

Referring FIG. 1*c*, the fuse 100 is shown in a fully assembled, operative configuration and orientation. The first and second terminals 114, 116 and the fusible element 112 are bent or folded around the longitudinally-opposing sidewalls 126, 130 and the cover 120 and are disposed in substantially flat abutment therewith. The bottom surfaces 158, 160 of the first and second terminals 114, 116 are thus positioned for electrical connection to corresponding terminals or contacts on an underlying surface (e.g., terminals on a printed circuit board (PCB)). Additionally, the bent first and second terminals 114, 116 may operate to securely clamp and hold the cover 120 and the base 118 together. Thus, when the fuse 100 is fully assembled and operatively oriented as shown in FIG. 1*c*, the vertical orientation of the fuse 100 is reversed relative to the orientation of the partially assembled fuse 100 shown in FIGS. 1*a* and 1*b*, with base 118 of the fully assembled fuse 100 being disposed on top of the cover 120 of the fuse 100.

Figure 2:
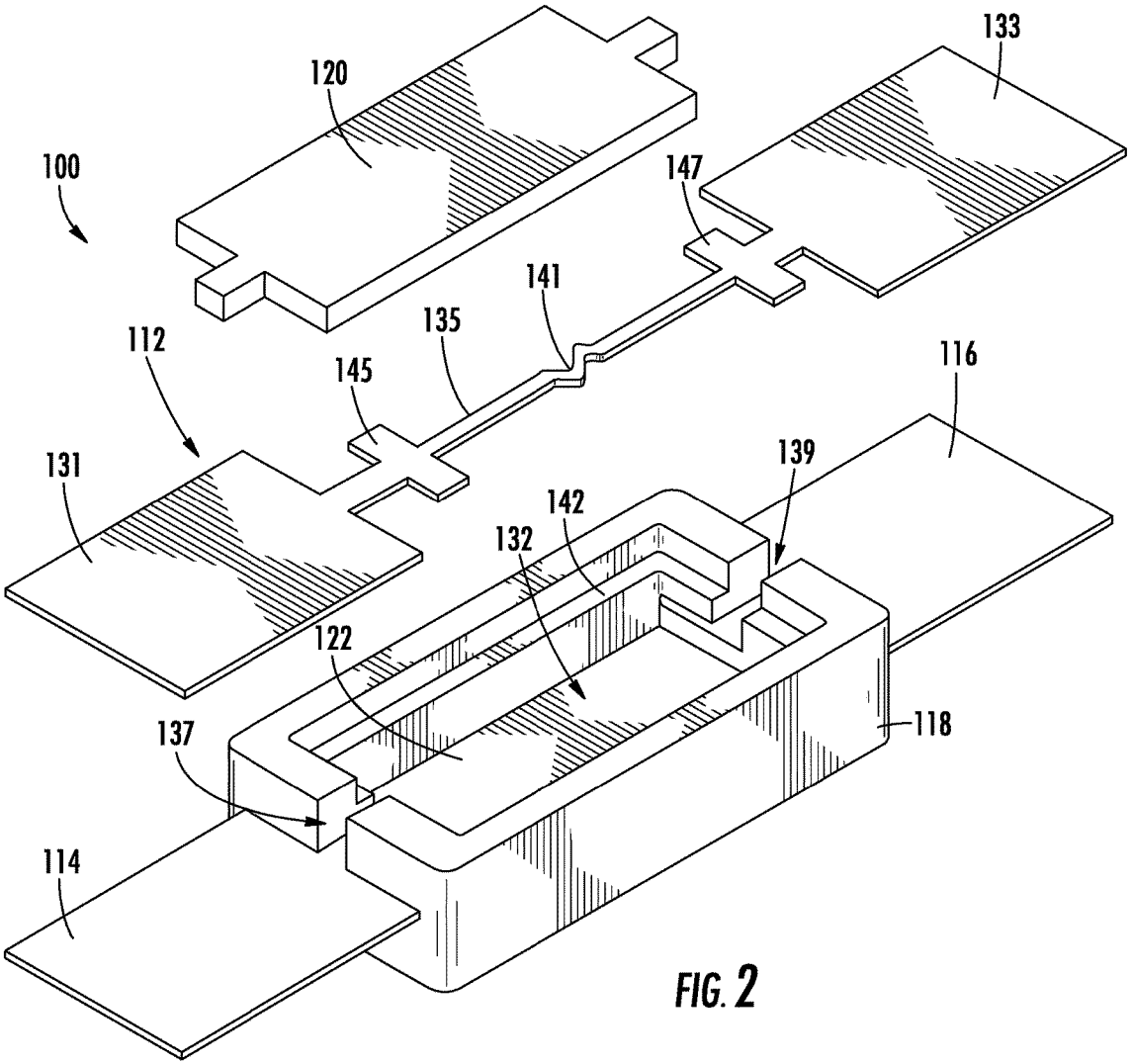
FIG. 2 is an exploded perspective view illustrating a surface mount fuse in accordance with an alternative embodiment of the present disclosure.

In an alternative embodiment of the fuse 100 shown in FIG. 2, fuse 100 may be provided with a substantially planar fusible element 112 that may be formed from a sheet of electrically conductive material, such as by stamping or cutting. The fusible element 112 may include first and second terminal portions 131, 133 that may be disposed atop, and electrically connected to, the first and second terminals 114, 116 in flat engagement therewith. The first and second terminal portions 131, 133 may be connected to one another by a bridge portion 135 that extends through the interior cavity 132 and notches 137, 139 of the base 118. First and second flanges 145, 147 may extend laterally from the bridge portion 135 longitudinally inward of the first and second terminal portions 131, 133, respectively, and may be disposed atop the recessed shoulder 142. The first and second flanges 145, 147 may facilitate accurate placement of the fusible element 112 during manufacture of the fuse 100 and may provide the bridge portion 135 with stability. The bridge portion 135 may have a thinned portion 141 that may be configured to melt and separate upon the occurrence of a predetermined fault condition, such as an overcurrent condition in which an amount of current exceeding a predefined maximum current flows through the fusible element 112.

Figure 3:
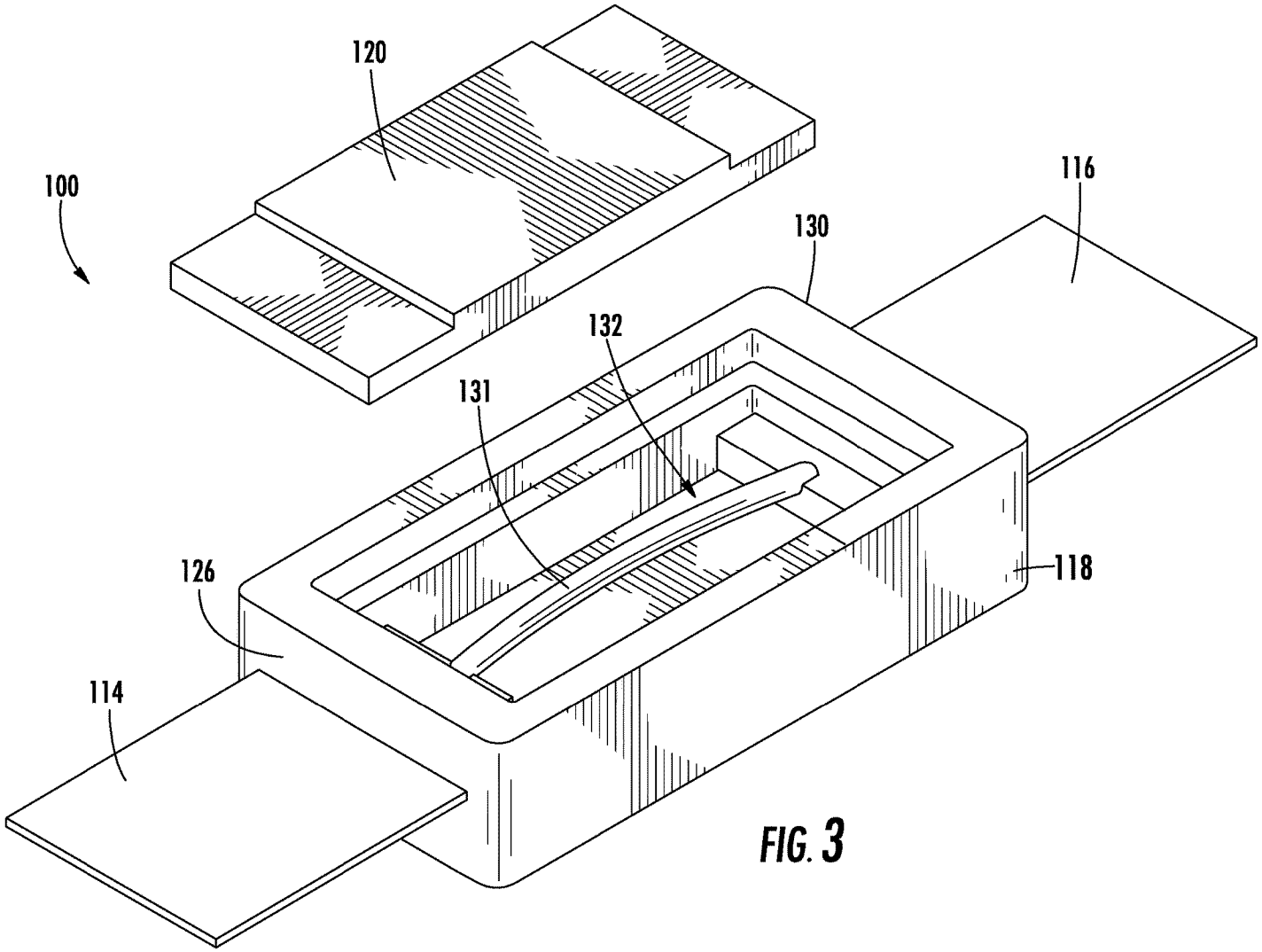
FIG. 3 is an exploded perspective view illustrating a surface mount fuse in accordance with another alternative embodiment of the present disclosure.

In another alternative embodiment of the fuse 100 shown in FIG. 3, the above-described notches 137, 139 may be omitted from the base 118 of the fuse body 117 and the fusible element 112 may be disposed entirely within the interior cavity 132 of the fuse body 117. In contrast to the embodiment of the fuse 100 shown in FIGS. 1*a-c*, wherein the first and second terminals 114, 116 extend toward the interior cavity 132 only insofar as the interior surfaces of the sidewalls 126, 130, the first and second terminals 114, 116 of the embodiment shown in FIG. 3 may extend inward beyond the sidewalls 126, 130 and into the interior cavity 132 where they are connected to the fusible element 112. In a non-limiting example, the fusible element 112 may be connected to the first and second terminals 114, 116 via wire bonding or similar processes.

Figures 4A, 4B:
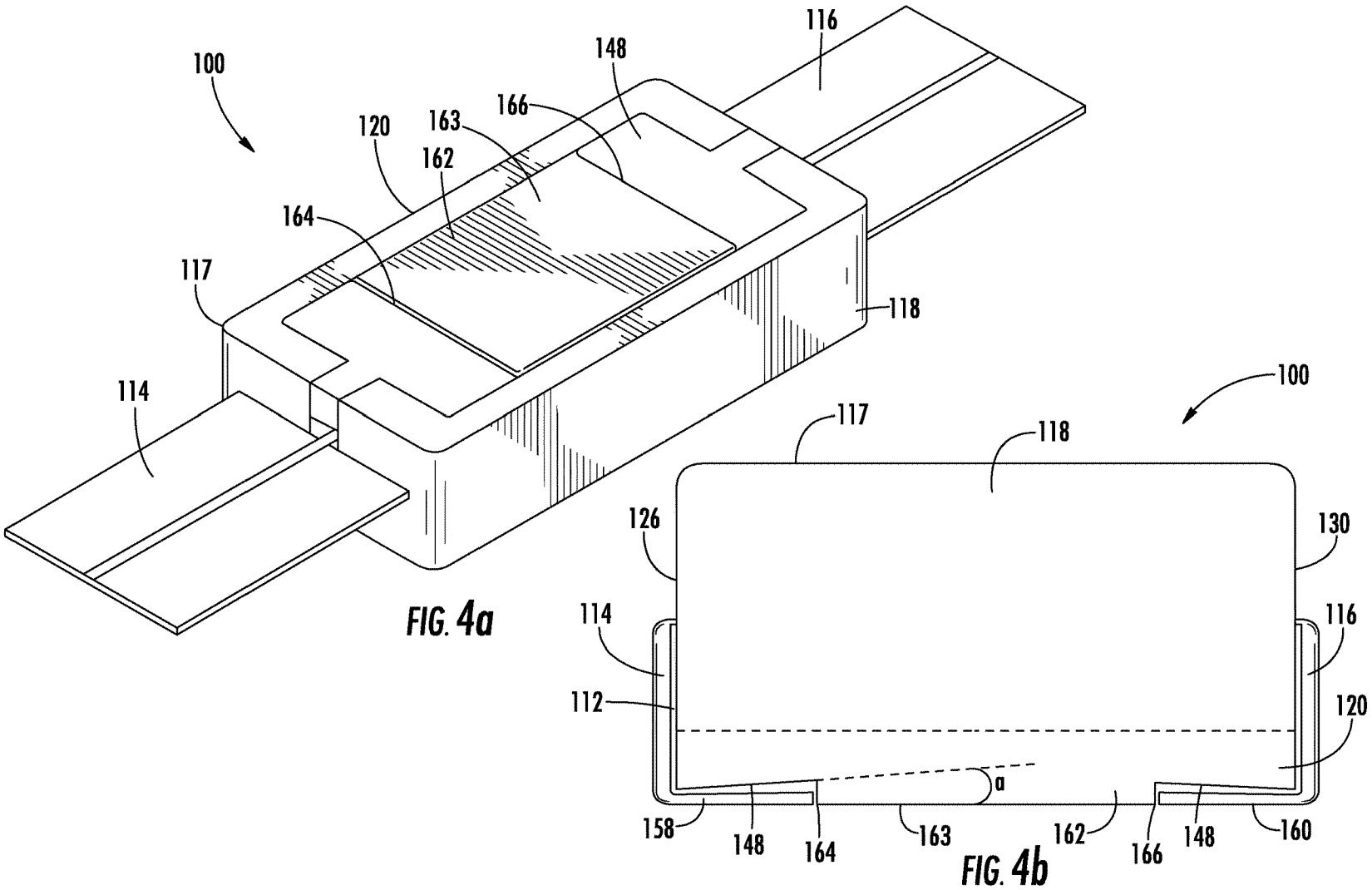
FIG. 4*a* is a perspective view illustrating a surface mount fuse in accordance with another alternative embodiment of the present disclosure.
FIG. 4*b* is a side view illustrating the surface mount fuse shown in FIG. 4*a* in a fully assembled configuration.

In another alternative embodiment of the fuse 100 shown in FIG. 4*a*, the fuse body 117 may include a cover 120 having a stepped protrusion or plateau 162 extending from the top surface 148 thereof and defining an elevated surface 163. Longitudinal edges 164, 166 of the plateau 162 may be spaced inwardly from the longitudinal ends of the fuse body 117. As best shown in FIG. 4*b*, the top surface 148 of the cover 120 may be angled toward the longitudinal edges 164, 166 of the plateau 162, and may intersect the longitudinal edges 164, 166 to form acute angles $\alpha$ therewith. In a non-limiting example, the acute angles $\alpha$ formed by the intersections of the top surface 148 with the longitudinal edges 164, 166 may be in a range of about 10 degrees to about 15 degrees. Thus, when the first and second terminals 114, 116 and the fusible element 112 are bent or folded around the longitudinally-opposing sidewalls 126, 130 and the cover 120, the bottom surfaces 158, 160 may be bent beyond parallel relative to the elevated surface 163 of the cover plateau 162. However, due to the resilience or "springiness" of the first and second terminals 114, 116 and/or the fusible element 112, the first and second terminals 114, 116 and the fusible element 112 may "un-bend" slightly away from the top surface 148, bringing the bottom surfaces 158, 160 of the first and second terminals 114, 116 into substantially coplanar alignment with the elevated surface 163 of the plateau 162. Thus, the fuse 100 may have a substantially flat bottom surface which may provide enhanced stability when the fuse 100 is operatively mounted on a PCB or other substrate.

Figure 5:
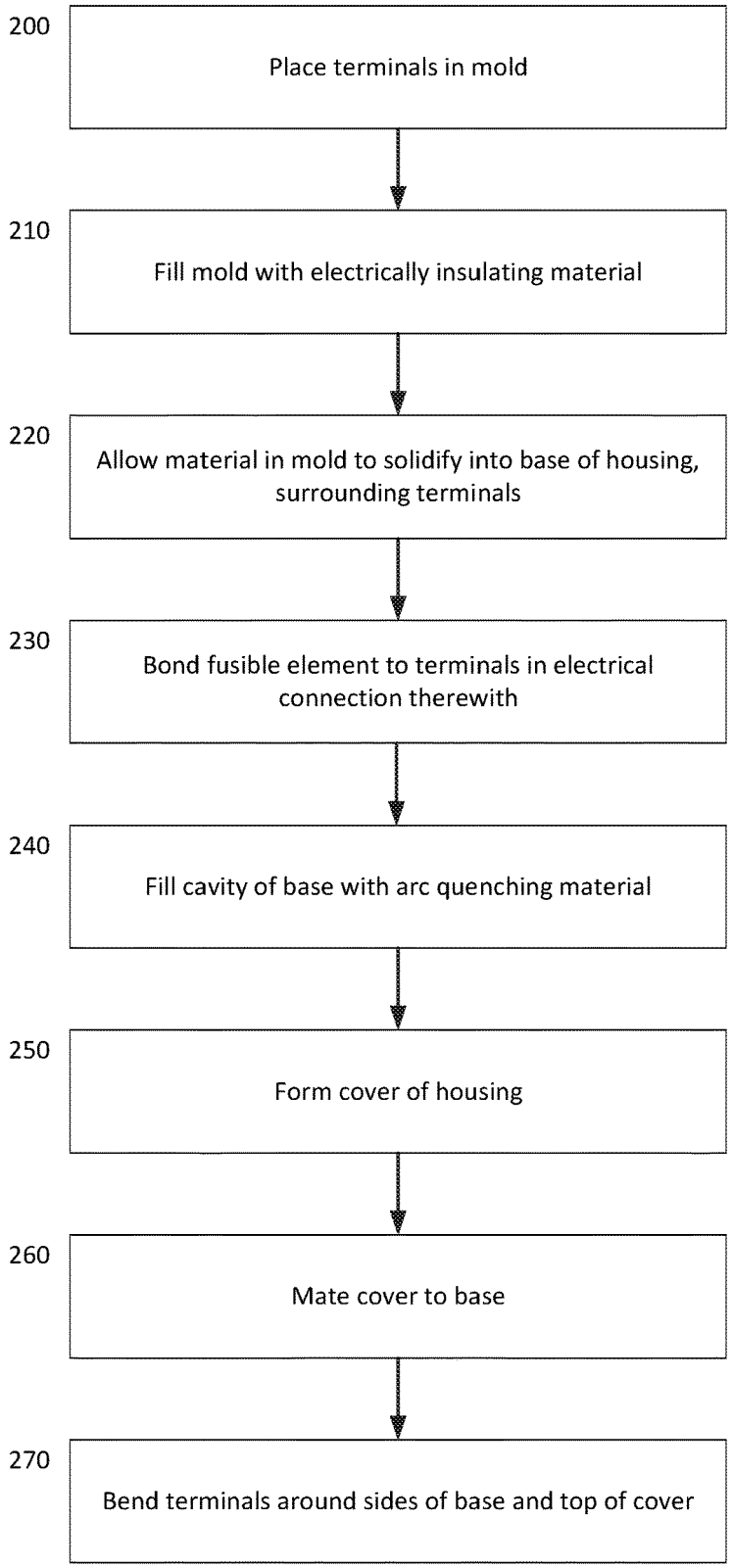
FIG. 5 is a flow diagram illustrating an exemplary method of manufacturing a surface mount fuse in accordance with the present disclosure.

Referring to FIG. 5, a flow diagram illustrating an exemplary method for manufacturing the above-described fuse 100 in accordance with the present disclosure is shown. The method will now be described in conjunction with the illustrations of the fuse 100 shown in FIGS. 1*a*-4*b*.

At block 200 of the exemplary method, the first and second terminals 114, 116 may be placed in a mold (not shown) in a desired position and orientation (e.g., the position and orientation shown in FIG. 1*a*) relative to one another. The mold may define a cavity having a size and a shape that are substantially similar to the desired size and shape of the base 118 of the fuse body 117 according to, but not limited to, any of the embodiments described above. At block 210 of the method, the mold may be filled with a molten or fluidic electrically insulating material (e.g., plastic) from which the base 118 is to be formed. For example, the mold may be filled using conventional injection molding processes. At block 220 of the method, the base 118 may be allowed to solidify in the mold and may subsequently be removed from the mold. The base 118 may thus be "molded onto" the first and second terminals 114, 116.

At block 230 of the exemplary method, the fusible element 112 according to, but not limited to, any of the embodiments described above may be bonded to the first and second terminals 114, 116, with a middle portion of the fusible element 112 extending longitudinally through the interior cavity 132 of the base 118. In various non-limiting examples, the fusible element 112 may be cut from a spool of wire (e.g., tin or copper wire) or stamped from a sheet of metal and may be bonded to the first and second terminals 114, 116 using any of a variety of bonding techniques, including, but not limited to, soldering, ultrasonic welding, laser welding, resistance welding, wire bonding, etc. At block 240 of the method, the interior cavity 132 of the base 118 may be filled with an arc quenching material (e.g., sand, silica, etc.) which may surround the fusible element 112.

At block 250 of the exemplary method, the cover 120 may be formed with a size and a shape adapted for mating with the base 118 as described above. In a non-limiting example, the cover 120 may be formed from the same electrically insulating material as the base 118 using injection molding or a similar process. The cover 120 may optionally be formed with a longitudinally-recessed plateau 162 extending from the top surface thereof as shown in FIGS. 4*a* and 4*b*. At block 260 of the method, the cover 120 may be mated to the base 118 as described above, with the main body 143 of the cover 120 being disposed atop the recessed shoulder 142 and with the flanges 144, 146 being disposed within the notches 137, 139, for example.

At block 270 of the exemplary method, the first and second terminals 114, 116 and the fusible element 112 may be bent or folded around the longitudinally—opposing sidewalls 126, 130 and the cover 120 and may be disposed in substantially flat abutment therewith. If the cover is provided with a plateau 162 as shown in FIGS. 4*a* and 4*b*, the ends of the first and second terminals 114, 116 may abut the longitudinal edges 164, 166 of the plateau 162, and the bottom surfaces 168, 170 of the first and second terminals 114, 116 may be disposed in substantially coplanar alignment with the elevated surface 163 of the plateau 162 to provide the fuse 100 with a substantially flat bottom surface.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A surface mount fuse comprising:

a fuse body comprising:

a base including a floor and a plurality of adjoining sidewalls defining an interior cavity, wherein top edges of the sidewalls define a recessed shoulder bordering the interior cavity; and a cover including a main body disposed on the recessed shoulder and enclosing the interior cavity;

first and second terminals extending through opposing sidewalls of the base, the first and second terminals extending around the opposing sidewalls and the cover and disposed in abutment therewith; and a fusible element extending through the interior cavity and connected to the first and second terminals, the fusible element including a bridge portion extending between first and second terminal portions, the first and second terminal portions disposed in flat engagement with the first and second terminals, respectively, the fusible element further including flanges extending from the bridge portion within the interior cavity, the flanges disposed on the recessed shoulder.

2. The surface mount fuse of claim 1, wherein the cover includes flanges extending from longitudinal ends thereof, the flanges disposed within complementary notches formed in the top edges of the opposing sidewalls of the base.

3. The surface mount fuse of claim 2, wherein the fusible element extends out of the interior cavity through the notches.

4. The surface mount fuse of claim 1, wherein a top surface of the cover is coplanar with the top edges of the sidewalls of the base.

5. The surface mount fuse of claim 1, wherein the first and second terminals secure the cover to the base.

6. The surface mount fuse of claim 1, wherein the cover includes a plateau extending from a top surface thereof and defining an elevated surface, wherein ends of the first and second terminals abut edges of the plateau and wherein bottom surfaces of the first and second terminals are coplanar with the elevated surface.

7. The surface mount fuse of claim 6, wherein the top surface of the cover intersects edges of the plateau at acute angles therewith.

8. The surface mount fuse of claim 7, wherein the acute angles are in a range of 10 degrees to 15 degrees.

9. The surface mount fuse of claim 1, further comprising an arc quenching material disposed within the interior cavity.

* * * * *